United States Patent [19]

Janus

[11] 4,074,538

[45] Feb. 21, 1978

[54] WALL STRUCTURES

[76] Inventor: Jürgen Peter Janus, Neuer Markt 17, 5657 Haan, Rhineland, Germany

[21] Appl. No.: 661,337

[22] Filed: Feb. 25, 1976

[30] Foreign Application Priority Data

| | | |
|---|---|---|
| Mar. 26, 1975 | Germany | 2513268 |
| July 21, 1975 | Germany | 2532520 |

[51] Int. Cl.[2] ..... E02D 17/00

[52] U.S. Cl. ..... 61/47; 61/3; 61/4; 61/49; 256/12.5

[58] Field of Search ..... 61/49, 3, 4, 5, 50, 61/51, 35, 39, 47; 244/114 B; 181/33 HE; 256/12.5, 64

[56] References Cited

U.S. PATENT DOCUMENTS

| | | | |
|---|---|---|---|
| 88,523 | 3/1869 | Smith | 256/64 |
| 90,117 | 5/1869 | Nevison | 256/64 |
| 130,682 | 8/1872 | Willie | 256/64 |
| 810,630 | 1/1906 | Dwight | 61/4 |
| 1,489,428 | 4/1924 | Cushing | 61/4 |
| 1,880,838 | 10/1932 | Curney | 61/3 |
| 2,014,116 | 9/1935 | Powers | 61/4 |
| 2,138,037 | 11/1938 | Lane | 61/39 UX |
| 2,927,779 | 3/1960 | Umberger | 256/59 X |
| 3,309,876 | 3/1967 | Potter | 61/3 |
| 3,966,172 | 6/1976 | Garrett | 256/12.5 |

FOREIGN PATENT DOCUMENTS

| | | | |
|---|---|---|---|
| 1,071,738 | 12/1959 | Germany | 256/12.5 |
| 197,519 | 8/1938 | Switzerland | 61/4 |
| 480,911 | 3/1938 | United Kingdom | 61/49 |

*Primary Examiner*—Dennis L. Taylor
*Attorney, Agent, or Firm*—Michael J. Striker

[57] ABSTRACT

The invention relates to an acoustic barrier wall made of prefabricated parts, preferably of artificial stone, concrete or the like, characterized in that the prefabricated parts comprise transverse supporting structures and longitudinal wall panels, these parts being arranged so that they can be joined together to form a retaining cage which becomes stepwise narrow towards the top, for containing fill material, for example earth.

11 Claims, 17 Drawing Figures

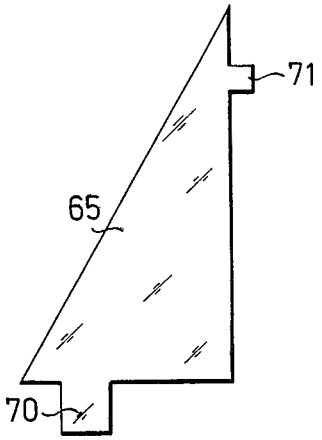
FIG. 7
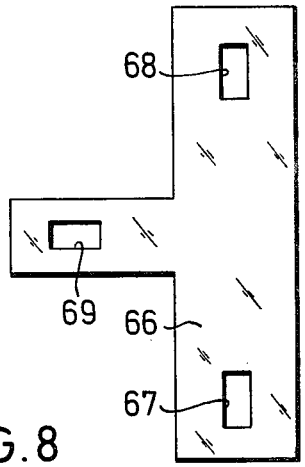
FIG. 8
FIG. 9
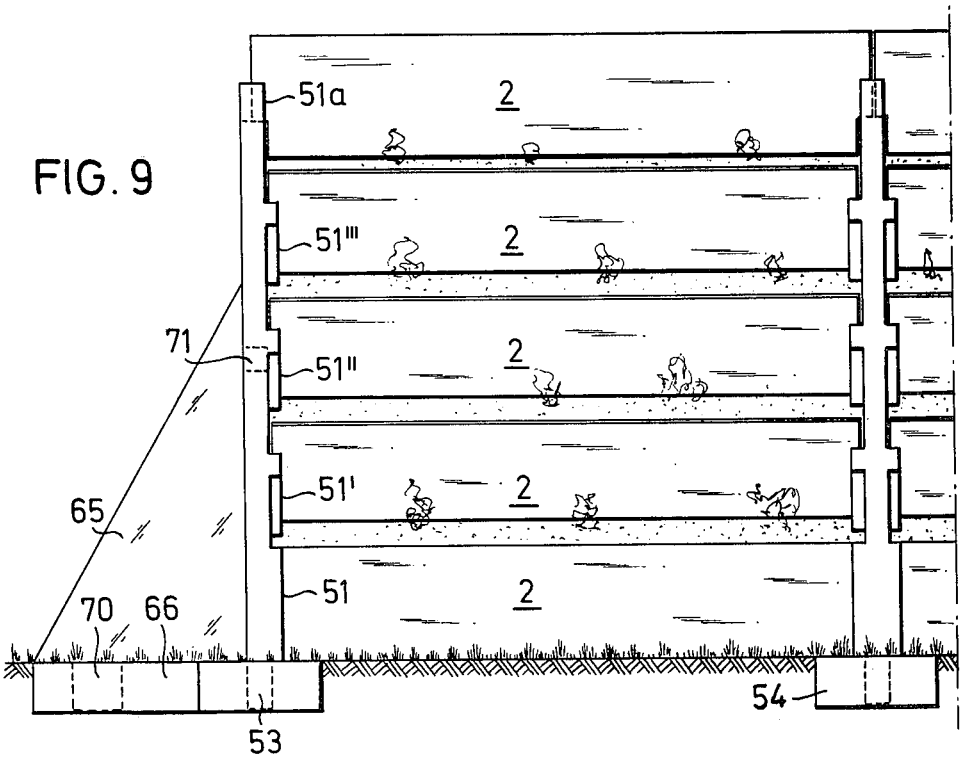

WALL STRUCTURES

BACKGROUND OF THE INVENTION

The invention relates to an acoustic barrier wall, which wall may be an escarpment reinforcement or a retaining wall for an embankment, the skeletal load bearing structure of the wall being made of prefabricated parts, preferably of artificial stone, concrete or the like.

Effective acoustic barrier walls running along by the side of motorways and the like are usually constructed in the form of earth escarpments. For engineering reasons these structures usually have a height-to-width ratio of 1 : 2, or less than 1 : 2. But earth escarpments of this kind are not only costly in construction but are also costly installations in the sense that they occupy large areas of ground. In most cases it is not even possible to construct them, alongside main traffic arteries, simply because the area of ground is not available.

SUMMARY OF THE INVENTION

The intention in the present invention is to remove these difficulties. The invention starts out from the concept of using prefabricated parts for constructing the acoustic barrier wall and/or escarpment reinforcement, so as to increase the ratio of height to width, that is to say so as to reduce the width of the area of ground occupied to something more tolerable, without reducing the effectiveness of the acoustic protection provided.

The problem is solved according to the invention in that the prefabricated parts comprise transverse supporting structures and longitudinal wall panels, these parts being arranged so that they can be joined together to form a retaining cage which becomes stepwise narrower towards the top, for containing fill.

In other words a pyramid-shaped, or rooflike structure of prefabricated parts is used, consisting of transverse structures supporting longitudinal wall panels arranged stepwise, diagonally the one above the other, and forming between them an openwork cage or container which is then filled with earth or the like, in which plants can be grown. The prefabricated parts are keyed together so that a firm and stable structure results. The earth for the fill can very well be what is removed in the construction of, for example, the motorway. The gravitational load of the structural parts, and of the entire acoustic barrier wall is supported by the virgin ground. The prefabricated parts can if necessary be arranged to provide diagonal support or a triangulated supporting structure. The prefabricated parts according to the invention give the acoustic barrier wall a much higher ratio of height to width, compared to an earth escarpment, the ratio of height to width being easily 1:1 or even as much as 1:0.7. Planting the acoustic barrier wall and/or escarpment reinforcement according to the invention with suitable vegetation not only provides an attractive appearance but also considerably improves the acoustic damping effect.

A particularly stable construction, for both acoustic barrier wall and escarpment reinforcements, and which involves comparatively few joining and securing devices in the construction of the transverse supporting structure, is characterised in that each transverse supporting structure has at least two supporting brackets positioned diagonally stepwise the one above the other for supporting the longitudinal wall panels.

This construction for the transverse supporting structures results in a stiff and stable acoustic barrier wall and/or escarpment reinforcement without any necessity to use extra structural members and consequently greatly simplifies assembly at the site.

In a preferred further development of the invention each transverse supporting structure is a framework consisting of two inclined beams sloping upwards towards each other roofwise, the inclined beams being tied rigidly together by at least one cross brace. The structure arranged in this way can be a single, integral unit, or it can be an assembly of parts. The inclined beams can be of the same length, or of different lengths, as can the cross braces. If the transverse supporting structure is a single integral unit, each inclined beam can have a vertically downwardly projecting foot of a cross section suitable for engaging in a socket in a foundation block.

In an acoustic barrier wall installed on level ground the two inclined beams are usually of the same length. On the other hand, if the acoustic barrier wall is constructed on sloping ground, or if the structure is intended as an escarpment reinforcement, the two inclined beams can be of different lengths. In this case if the transverse supporting structure is a single, integral unit the longer inclined beam can be joined to the shorter one by a horizontal cross brace and a diagonal cross brace extending from the lower end of the longer inclined beam diagonally upwardly to the shorter inclined beam. If the transverse supporting structure consists of assembled parts, the two inclined beams are joined together securely at their upper ends by tie bolts or the like and have rounded feet which engage in correspondingly rounded sockets in a cross brace which joins the two inclined beams together. To make it possible for the cross brace to be installed inclined, the curvatures of the rounded sockets become wider in the upward direction, so that inclined beams having different slopes, relative to the cross brace, can be supported in the rounded sockets of the cross brace.

If the prefabricated parts according to the invention are to be used exclusively for reinforcing an escarpment, then in a further preferred version of the invention each transverse supporting structure consists of a horizontal cross beam whose forward end has an inclined support for supporting the lower longitudinal wall panels and, near the inclined support, a preferably vertically upwards projecting support which has at least one further inclined support for upper longitudinal wall panels.

This results in a one-piece transverse supporting structure which is particularly simple and robust. The horizontal cross beam has, underneath the inclined support for the lower longitudinal wall panel, a notch or a projection by which the horizontal cross beam is supported on a foundation block, the horizontal cross beam having at its rear end an upper notch, or a projection, for anchoring in place a counterweight panel or the like. The counterweight panel is preferably long enough to ensure that it rests with its two ends on at least two neighboring transverse supporting structures.

BRIEF DESCRIPTION OF THE DRAWING

Further details and advantages of the invention may be derived from the following description of the several examples represented in the drawing, in which:

FIG. 7 is a front view of an end support.

FIG. 8 is a plan view of a foundation block for the end portion of the acoustic barrier wall made of the parts shown inFIGS. 1 to 6.

FIG. 9 is a front view of an acoustic barrier wall, showing the parts in position.

SPECIFIC DESCRIPTION OF PREFERRED EMBODIMENTS

Figure 1:
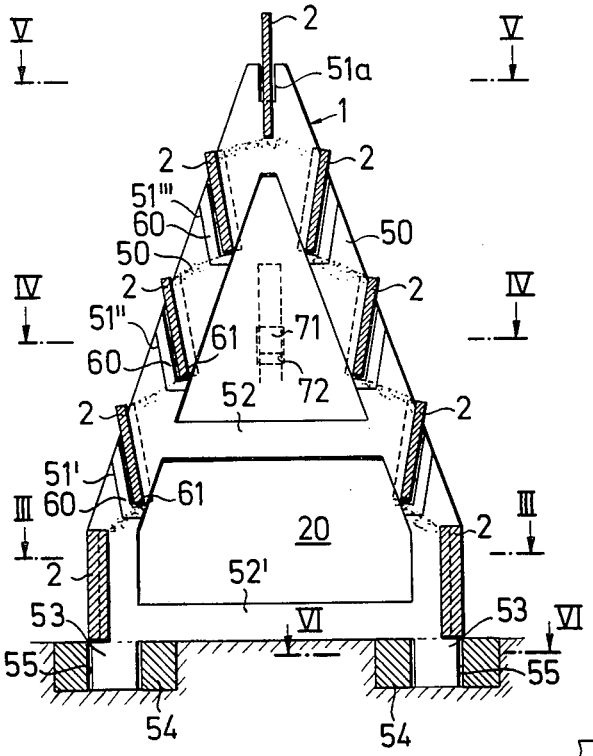
FIG. 1 is a vertical cross section through an acoustic barrier wall according to the invention.
Figure 2:
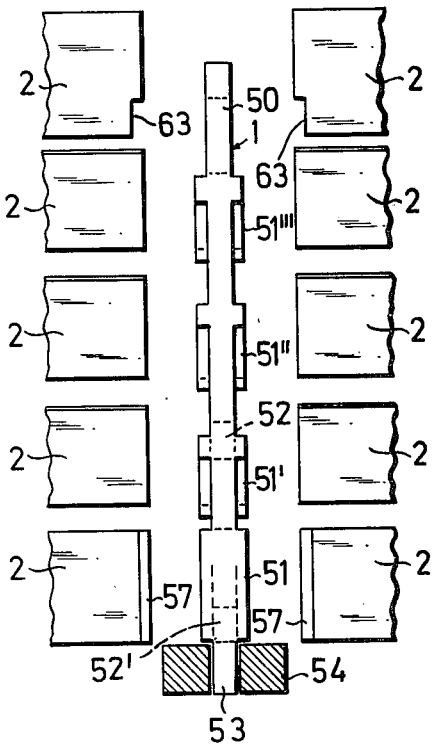
FIG. 2 is a front view showing the parts of the barrier wall separated from each other for greater clarity in the drawing.
Figure 5:
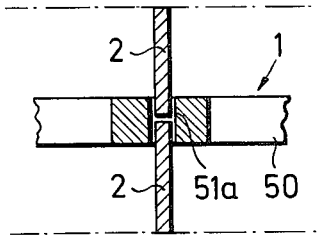
FIG. 5 is a horizontal section taken in the plane V—V in FIG. 1.
Figure 4:
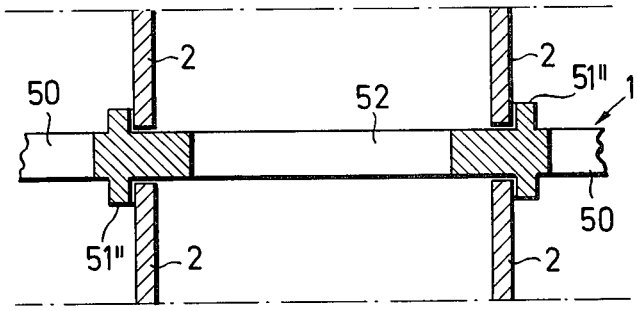
FIG. 4 is a horizontal section taken in the plane IV—IV in FIG. 1.
Figure 3:
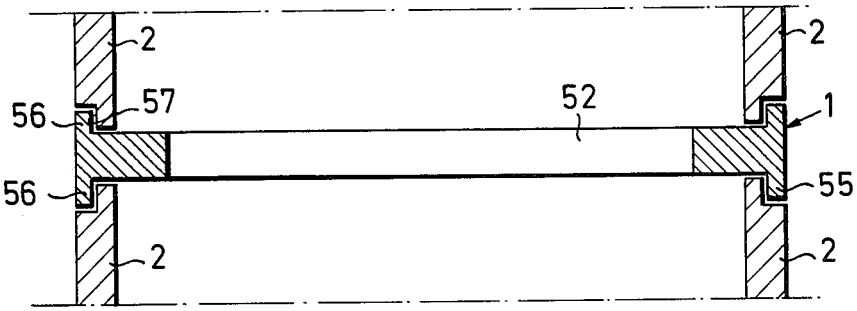
FIG. 3 is a horizontal section taken in the plane III—III in FIG. 1.
Figure 6:
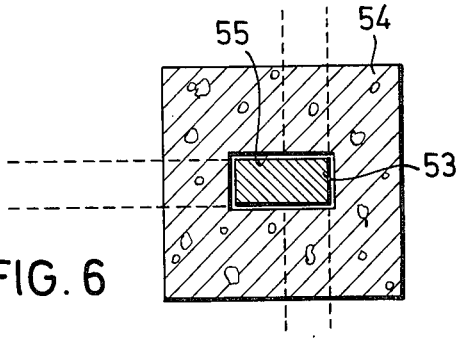
FIG. 6 is a horizontal section through a foundation block, taken in the plane VI—VI in FIG. 1.

As shown in the drawing, the protective acoustic barrier wall and escarpment constructed of the structural parts according to the invention consists essentially of a number of transverse structures 1 supporting longitudinal wall panels 2 so as to form a prism-shaped internal chamber 20 for accommodating fill material, the structure becoming narrower towards the top.

In the version shown in FIGS. 1 to 10 each transverse supporting structure 1 is a one-piece structure consisting essentially of two inclined beams 50 which meet at the top. Each inclined beam 50 has a number of lateral inclined brackets 51 which support the ends of longitudinal wall panels 2.

The two inclined beams 50 are tied rigidly together by at least one horizontal cross brace 52. At its lower end each inclined beam 50 has a vertical downwards projecting foot 53, at least the lower portion of the foot having a cross section dimensioned for insertion into a socket 55 in a foundation block 54.

This version of the invention is intended for installation on level ground. Consequently the two inclined beams 50 are of equal length. The two projecting feet 53 are tied together rigidly by a further horizontal cross beam 52'.

Whereas the upper longitudinal wall panels 2 are mounted stepwise, the one diagonally above the other, with their ends supported by the lateral inclined brackets 51 of the transverse supporting structure 1, the lowest longitudinal wall panels 2 are mounted vertical and are retained, by their ends, by vertical flanges 56 (FIG. 3) projecting laterally from the supporting structure 1. The ends of the lowest longitudinal wall panels 2 have laterally extending flanges 57 which engage behind the vertical flanges 56. The outer surfaces of the lowest wall panels 2 form, together with the outer surfaces of the supporting structure 1, in this region, a continuous vertical wall surface. The lowest wall panels 2 stand on edge on the foundation blocks 54.

The lateral inclined brackets 51', 51'' . . . for the upper longitudinal wall panels 2 are positioned diagonally stepwise above each other along the length of each inclined beam 50 of the supporting structure 1. Each lateral inclined bracket 51', 51'' . . . consists of an inclined rib 60 and a lower shelf-rib 61. Each upper longitudinal wall panel 2, whose ends are supported by the inclined brackets 51', 51'' . . . , therefore slopes slightly outwardly, with its upper edge a little further away from the center line of the supporting structure 1 than its lower edge. Each upper longitudinal wall panel 2 is a simple rectangular plank-like structure, although it can if described be somewhat thicker in its middle portion.

The uppermost longitudinal wall panels 2 are supported by their ends in a vertical slot **51*a* in the apex of the supporting structure 1. These uppermost longitudinal wall panels 2 are therefore vertically positioned. Each uppermost longitudinal wall panel 2 can if desired have a corner notch 63**, to retain it in position longitudinally.

In FIG. 9 one of the supporting structures 1, at the left, is at the end of the acoustic barrier wall. This supporting structure 1 is therefore preferably plain on one side, that is to say without lateral inclined brackets on this side. To make it unnecessary to construct costly earthworks here, the end of the acoustic barrier wall can be supported longitudinally by an end-support 65 which is keyed to the supporting structure 1 and rests on a special foundation block 66 which has at least three sockets 67, 68, 69. Of these, the sockets 67 and 68 are for the feet 53 of the supporting structure 1. The third socket 69 is to take a downwardly projecting foot 70 of the end-support 65. A projection 71, near the top end of the end-support 65, engages in a socket 72 in the supporting structure 1, as shown in broken lines in FIGS. 1 and 9.

Figure 11:
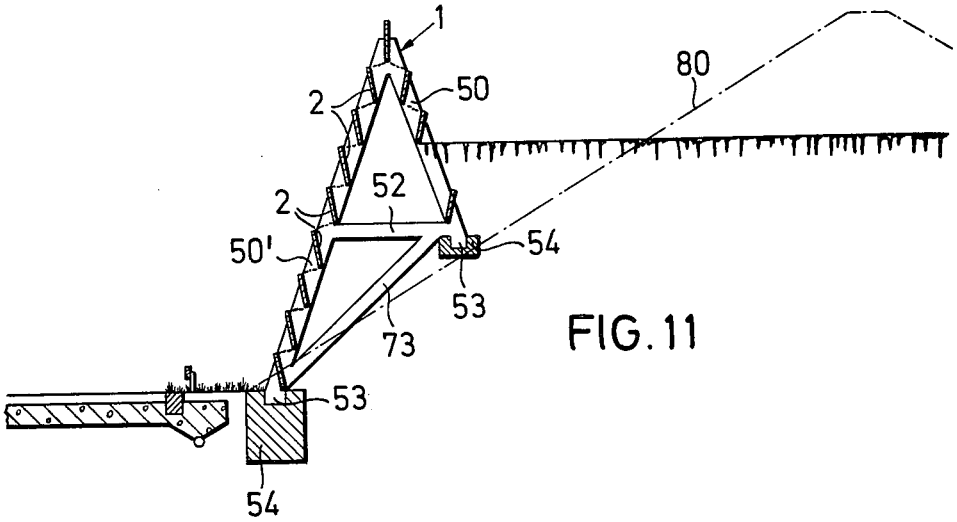
FIG. 11 shows a modified version of the invention which also serves as a support for an escarpment.
Figure 12:
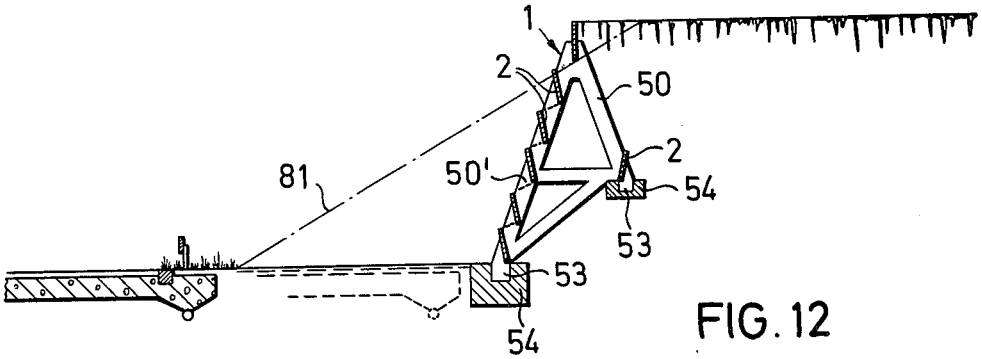
FIG. 12 shows a pure escarpment support made of the constructional parts according to the invention.

In the version of the invention shown in FIGS. 11 and 12 the inclined beams 50, 50' of the supporting structure 1 have different lengths. The two inclined beams 50, 50' have lateral inclined brackets 51, 51', 51'', 51''' . . . for supporting the longitudinal wall panels 2. The two inclined beams 50, 50' are tied together rigidly by at least one horizontal cross brace 52 and, in addition to this, by an extra diagonal cross brace 73 extending from the lower end of the longer inclined beam 50' diagonally upwards to the lower portion of the shorter inclined beam 50. Each of the two inclined beams 50, 50' has a vertical foot 53 engaging in a socket 55 in a foundation block 54.

The version of the invention shown in FIG. 11 acts not only as an acoustic barrier wall but also serves for supporting the body of ground shown at the right, which is higher than the roadway on the left. If desired the lowest longitudinal panels 2 of the longer inclined beam 50' can be positioned vertical, as described with reference to FIG. 1, so as to present a smooth, continuous outer surface.

In FIG. 12 the structural parts according to the invention are arranged to serve purely as an escarpment support. And here again the lowest longitudinal wall panels 2 can if desired be positioned vertical, as in FIGS. 1 and 10.

Figure 10:
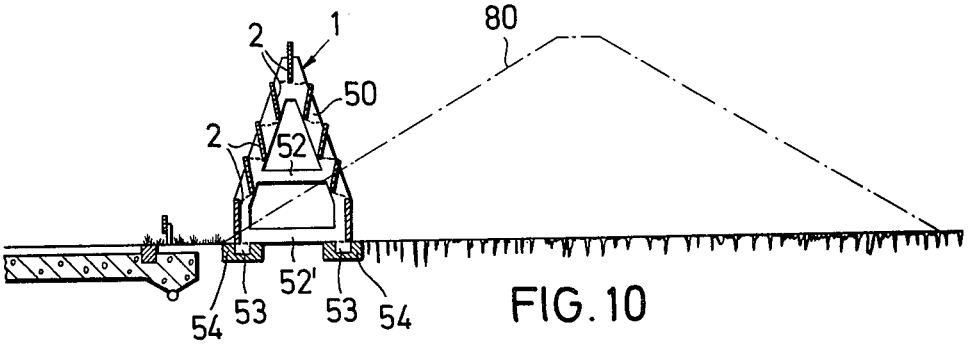
FIG. 10 shows diagrammatically a cross section of the acoustic barrier wall, compared with a conventional acoustic escarpment of the same height.

In the version of the invention shown in FIG. 12, in contrast to the versions of FIGS. 10 and 11, the longitudinal wall panels 2, including the uppermost one, all serve for supporting the escarpment, that is to say the ground behind the barrier. The shorter inclined beam 50 has, near its lower end, lateral inclined brackets 51 for supporting longitudinal wall panels 2 which serve for anchoring the supporting structure 1 firmly in the ground against the outward thrust applied by the earth to the other longitudinal wall panels 2.

FIGS. 10 to 12 illustrate other advantages of the invention, compared to ordinary earth escarpments and also compared to natural supports for escarpments. In FIG. 10 the upper surface of a natural earth wall of the same height is indicated in dot-dash lines at 80. The escarpment angle is assumed to be 1:1.5. The earth wall occupies an area of ground approximately six times wider than the acoustic barrier wall of the present invention. In FIG. 11 the natural earth wall 80, assuming an escarpment angle of approximately 1:1.5, would occupy a many times greater width of ground surface, compared to the acoustic barrier wall of the present invention.

In FIG. 12 the escarpment supporting structure of the present invention saves a considerable strip of ground, compared to the natural escarpment indicated in dot-dash lines at 81, which is assumed to have an escarpment angle of 1:1.5. The area saved can be utilized either in front of or behind the escarpment support.

Figure 13:
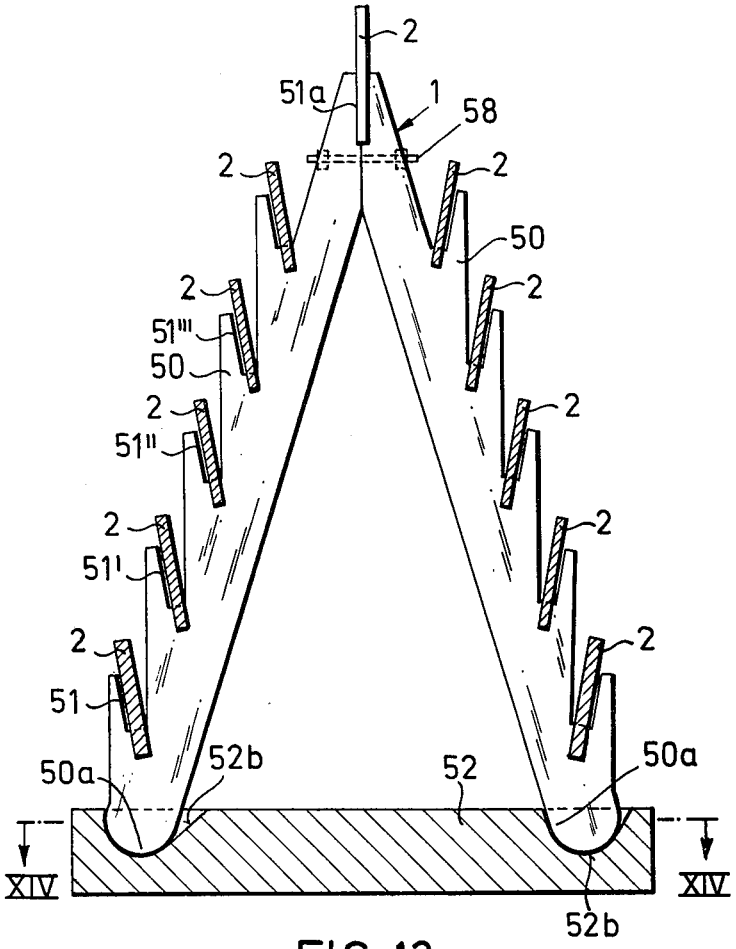
FIG. 13 is a cross section through a different version of the invention.
Figure 14:
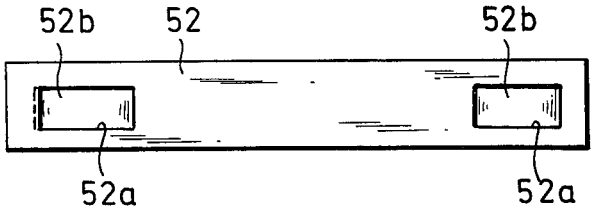
FIG. 14 is a plan view taken in the plane XIV—XIV of FIG. 13.

In the version of the invention shown in FIGS. 13 and 14 the two inclined beams 50 and the cross braces 52 of the supporting structure 1 do not form a single, integral unit. Two separate inclined beams 50 are used, joined together at the peak of the structure by tie bolts 58 or the like. The foot 50*a* of each inclined beam 50 is rounded and engages in a rounded socket 52*a* of a cross brace 52 which rigidly ties together the feet of the two inclined beams 50. The feet 50*a* are circularly rounded on a radius and the sockets 52*a* are rounded to essentially the same radius, but expand in the upward direction, so that inclined beams 50 having different slopes are supported with surface contact in the sockets. This allows the peak angle of the structure to be changed, compared to what is shown in FIG. 13. It also allows the two inclined beams 50, 50' to have different lengths, and the cross brace 52 need not be horizontal but can, if desired, be sloping. It will be observed that the radius on the feet 50*a* of the inclined beams 50 and the corresponding radius of the curvature 52*b* of the sockets 52*a* remain unchanged when inclined beams 50, 50' of different lengths are used and the cross brace 52 is installed sloping. The only changes involved are the different lengths of the inclined beams 50, 50' and the cross brace 52.

Figure 15:
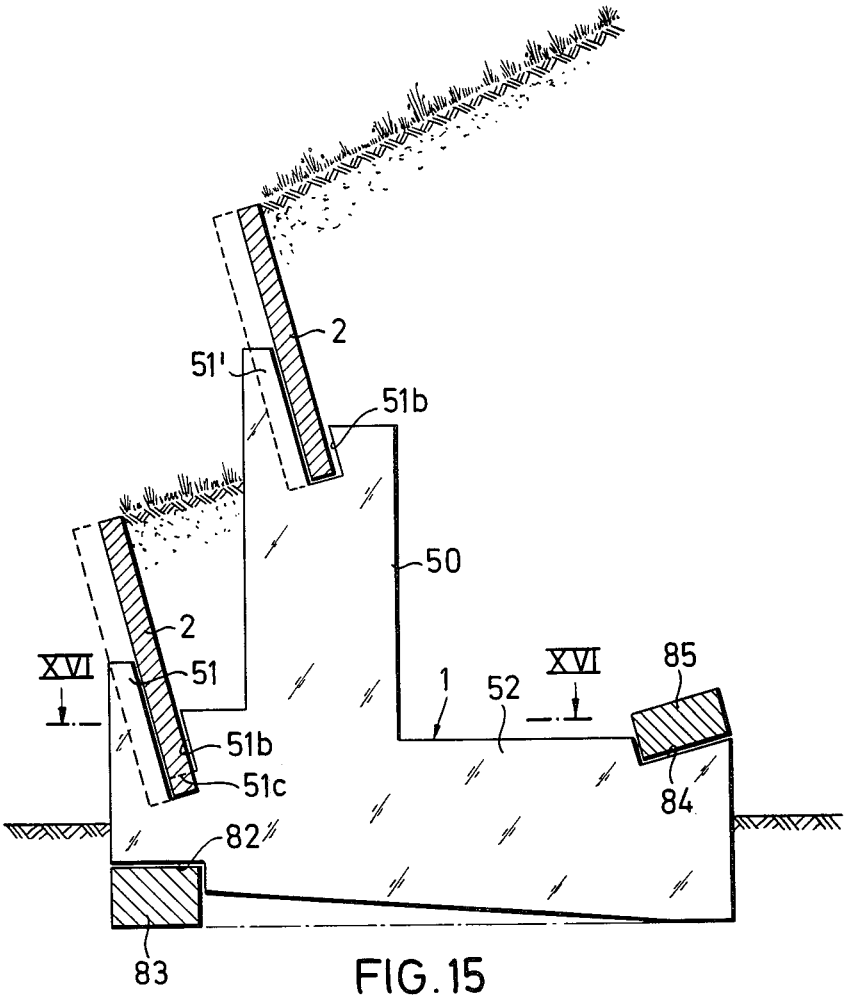
FIG. 15 is a cross section through a still further version of the invention.
Figure 16:
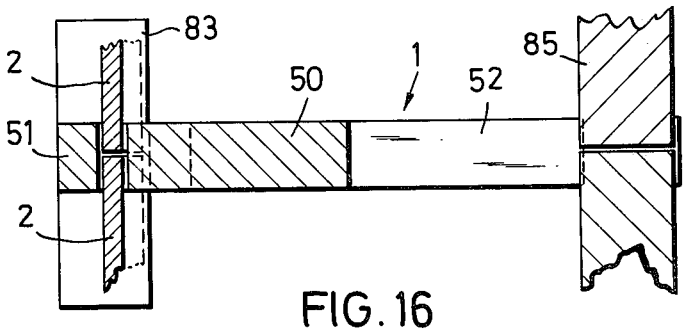
FIG. 16 is a horizontal section taken in the plane XVI—XVI of FIG. 15.

FIGS. 15 and 16 show a further advantageous version of the invention. In this case the structure is intended primarily as an escarpment reinforcement. Each transverse supporting structure 1 consists essentially of a horizontal cross brace 52, which has a lower inclined support 51 for lower longitudinal wall panels 2. From the horizontal cross brace 52 there projects upwards a preferably vertical support 50 which itself supports at least one further inclined support 51' for further longitudinal wall panels 2. At the bottom of each inclined support 51, 51' there is a retainer slot 51*b* for retaining at least the lower edge of the longitudinal wall panel 2, which can if desired have a lower corner notch 51*c*, as indicated in broken lines in FIG. 15. If desired the longitudinal wall panel can simply be rectangular, as shown near the top in FIG. 15.

At its forward end each horizontal cross brace 52 has a lower, preferably rectangular notch 82 underneath the inclined support 51. At its forward end the horizontal cross brace 52 rests on a longitudinal foundation block 83, which engages in the notch 82. The foundation block 83 can if desired extend as far as the neighboring transverse supporting structure 1.

At its rear end the horizontal cross brace 52 has an upper notch 84 which receives a counterweight panel 85 or the like. This is long enough to allow it to rest by its two ends on at least two transverse supporting structures 1, so that the weight of the escarpment fill compensates by the outwardly directed pressure applied to the longitudinal wall panels 2.

Instead of the two notches 82 and 84, to take the foundation block 83 and the counterweight panel 85, the horizontal cross brace 52 can if desired have projections for engaging in sockets in the foundation block and counterweight panel, to anchor the structure securely in the ground.

Figure 17:
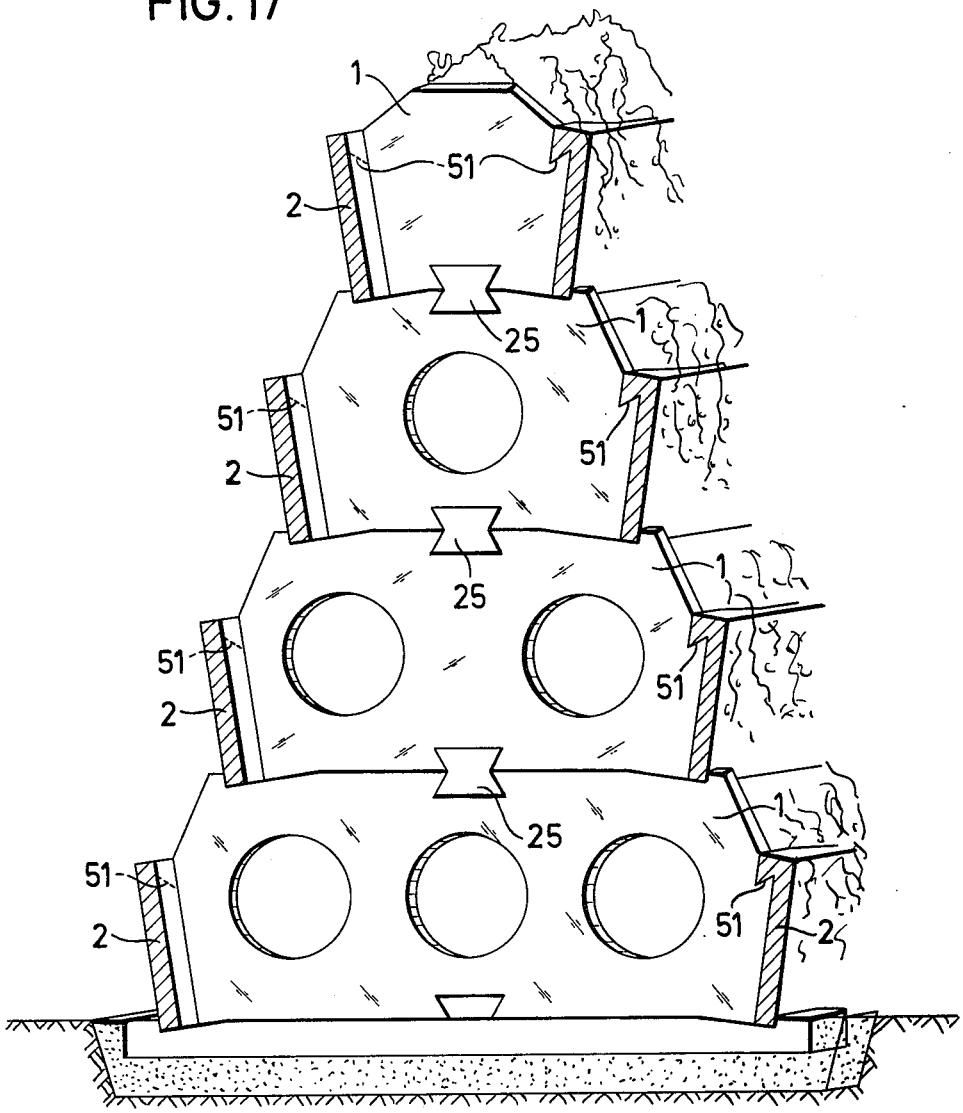
FIG. 17 is a still further possible version of the acoustic barrier wall, in this case constructed pyramid-fashion by superposing structural parts according to the invention.

Instead of using, for the transverse supporting structure, two inclined beams forming a triangular structure with the apex at the top, a structure of the kind shown in FIG. 17 can be used. This consists of several pierced transverse supporting structures 1 of decreasing width superposed above each other pyramid-fashion. Each structure 1 has at each end an inclined support 51 for supporting longitudinal wall panels 2, which together enclose a prismatic chamber to take fill, the chamber decreasing in width stepwise in the upward direction. But this structure requires further locking devices 25 between the supporting structures 1, the locking devices engaging in corresponding notches in the upper and lower edges of each supporting structure. This arrangement is therefore more costly both in construction and in assembly than the versions of the invention described above.

I claim:

1. An acoustic barrier wall comprising:

at least two concrete support structures spaced apart in a longitudinal direction and each having an apex and two beams standing on the ground and extending outwardly and downwardly from said apex to form an inverted V;

a plurality of support brackets integral with and spaced vertically along each of said beams and spaced horizontally in a direction transverse to said longitudinal direction;

a rectangular concrete elongated wall panel extending longitudinally between each of said support brackets on one of said structures and the corresponding support bracket on the other structure, said panels each being oriented generally vertically and defining an interior space substantially closed in the transverse horizontal direction and open in the upward direction, said brackets being so oriented that said wall panels each tip outwardly at their upper edges from the wall panels of the other beams; and a mass of earth filling said space and having an upper surface suitable for planting exposed between said wall panels.

2. The wall defined in claim 1 wherein said support brackets are notches formed in said beams and said wall panels have ends received in said notches.

3. The wall defined in claim 1, further comprising base member having two upwardly opening socket recesses receiving the lower ends of the beams of each of said structures.

4. The wall defined in claim 3 wherein said lower ends and socket recesses are complementarily shaped.

5. The wall defined in claim 1, further comprising means forming an uppermost support bracket at each of said apices and an uppermost wall panel received in said uppermost brackets and lying in a plane of symmetry of said wall.

6. The wall defined in claim 1, further comprising a cross brace extending in said transverse direction between said beams.

7. The wall defined in claim 1 wherein said beams are integrally formed of reinforced concrete.

8. The wall defined in claim 1 wherein said beam panels are integrally formed of reinforced concrete.

9. The wall defined in claim 1, further comprising means for securing said beams of each structure together at said apex.

10. The wall defined in claim 9 wherein said means for securing includes at least one bolt extending through the upper ends of said beams of each structure at said apex thereof in said transverse direction.

11. The wall defined in claim 1 wherein one of said beams of each of said structures is substantially longer than the other beam of the respective structure and is provided with more of said brackets and more of said wall panels.

* * * * *